US005457968A

United States Patent [19]

McClintock et al.

[11] Patent Number: 5,457,968

[45] Date of Patent: Oct. 17, 1995

[54] SEATING SUPPORT

[75] Inventors: Brian W. McClintock, Bloomfield Hills, Mich.; James H. Moreland, Irmo; David B. Skinner, Columbia, both of S.C.; James V. Snipes, Jr., Clemmons, N.C.

[73] Assignees: Shakespeare, Columbia, S.C.; Carolina Narrow Fabrics, Winston-Salem, N.C.; Brite Seating Technologies, Inc., Royersford, Pa.

[21] Appl. No.: 132,197

[22] Filed: Oct. 6, 1993

[51] Int. Cl.[6] ..... D04B 23/08; A47C 7/32; A47C 3/00

[52] U.S. Cl. ..... 66/202; 66/190; 66/192; 297/284.1

[58] Field of Search ..... 66/190, 192, 194, 66/202; 297/284

[56] References Cited

U.S. PATENT DOCUMENTS

| | | | |
|---|---|---|---|
| 2,118,108 | 5/1938 | Riley | 66/190 |
| 3,424,220 | 1/1969 | Dchuerch | 66/190 X |
| 3,651,014 | 3/1972 | Witsiepe | 260/75 R |
| 3,763,109 | 10/1973 | Witsiepe | 260/75 R |
| 4,051,579 | 10/1977 | Heimberger | 66/192 |
| 4,228,566 | 10/1980 | Matsuda | 66/190 X |
| 4,248,064 | 2/1981 | Odham | 66/192 |
| 4,469,738 | 9/1984 | Himelreich, Jr. | 428/198 |
| 4,469,739 | 9/1984 | Gretzinger et al. | 428/198 |
| 4,545,614 | 10/1985 | Abu-Isa et al. | 297/284 |
| 5,009,955 | 4/1991 | Abu-Isa | 428/401 |
| 5,013,089 | 5/1991 | Abu-Isa et al. | 297/452 |
| 5,280,887 | 1/1994 | Fontana | 66/190 X |
| 5,290,619 | 3/1994 | Siegel et al. | 66/192 X |

*Primary Examiner*—John J. Calvert
*Attorney, Agent, or Firm*—Donald W. Huntley

[57] ABSTRACT

A seating structure comprising a warp knit fabric attached to a frame, the fabric comprising at least one restraining cord adjacent each selvage of the fabric and elastomeric monofilament perpendicular to each restraining cord, the elastomeric monofilament being located along the full width of the fabric in the weft direction and substantially continuous from course to course, the structure being characterized by excellent long-term wear and seating comfort, particularly for automotive applications.

24 Claims, 4 Drawing Sheets

SEATING SUPPORT

BACKGROUND OF THE INVENTION

The present invention relates generally to support fabrics which are particularly well suited for use in automobile seating. More specifically, the present invention relates to seating support fabrics which are based upon specific weave configurations and specialized yarns.

Woven fabrics have long been used in automotive applications, both as seat covers and seat supports. However, consumers desire seating which provides higher comfort and also improved, long-term wear, while manufacturers strive to reduce the number and weight of the components needed to provide the spring support in seat constructions.

Conventional woven seating constructions often lack proper elastomeric support, and this can cause fatigue or discomfort, particularly when drivers are seated in their automobiles for long periods of time. Also, conventional seats are generally not well designed to handle jarring such as that due to uneven pavement, and the driver's bouncing movement can be uncomfortable and also harmful to many conventional fabrics.

Ideally, seat constructions should have sufficient elastomeric properties to gently, but firmly, cradle the seated driver, but they should not be so elastomeric as to create discomfort during long car rides or when the automobile is experiencing rough pavement. Furthermore, seat support fabrics should not be prone to permanent thread shifting, particularly during long periods of sitting or due to the bouncing action of a passenger. Such thread shifting can cause the seat to be less comfortable to the driver and have diminished ability to cradle and support the seated driver, particularly where a portion of the threads have permanently shifted.

Finally, conventional woven seating fabrics can sometimes lose a portion of their elastomeric characteristics over time or otherwise lack durability. An automobile's resale value can suffer if its seats are not comfortable to the prospective buyer or exhibit permanent deformation. Although secondary components, such as hooks, reinforcement strips, and the like, can be used to improve performance and durability of the seat, these additional components can increase cost, increase manufacturing complexity and complicate the installation of the seat.

Previously, the springs used in automotive seating were, in large measure, replaced by woven fabric having elastomeric performance. Such fabrics are described, for example, in Gretzinger et al, U.S. Pat. No. 4,469,739, and Himelreich, Jr., U.S. Pat. No. 4,469,738. However, the weaving techniques required for such fabrics are costly for automotive applications, and still further, long-term performance improvement is desirable.

SUMMARY OF THE INVENTION

The present invention provides a seating structure comprising an inexpensive, high performance seat support fabric which is a significant technical advance over previously known fabrics.

Specifically, the instant invention provides a seating structure comprising a warp knit fabric on a frame; the fabric having a front side, a rear side, at least one selvage, a plurality of wales and a plurality of courses, the fabric further comprising:

a) at least one restraining cord adjacent each selvage, located substantially in the warp direction; and b) an elastomeric monofilament substantially perpendicular to each restraining cord and located along the full width of the fabric in the weft direction, whereby the elastomeric monofilament is substantially continuous from course to course;

the restraining cord and elastomeric monofilament being knitted together in a mesh which locks the monofilament and cord together in a substantially permanent relative position when the fabric is in a substantially non-stretched state.

DETAILED DESCRIPTION OF THE INVENTION

Figure 1:
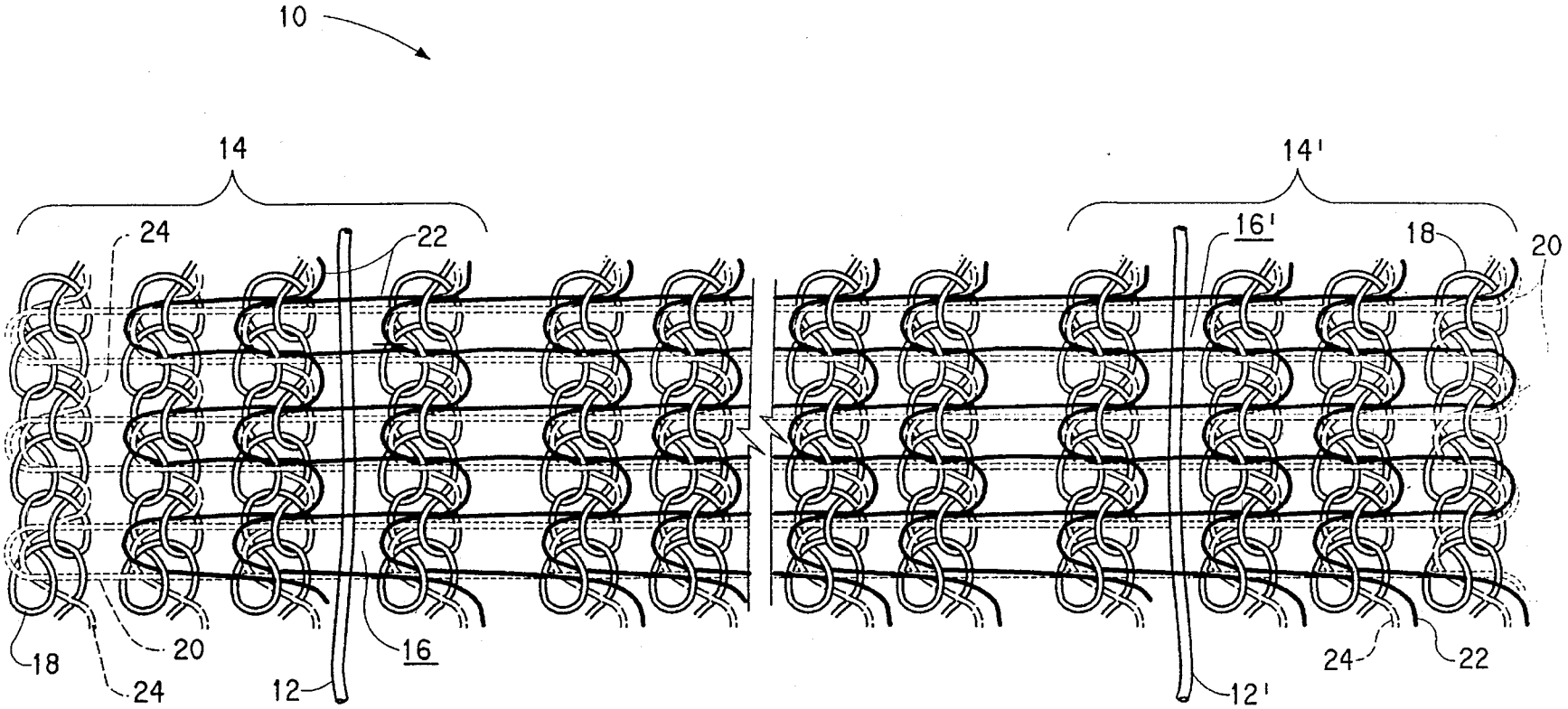
FIG. 1 is a magnified plan view of a preferred fabric of the present invention, whereby the knit configurations of each thread are illustrated.

The present invention is directed to a seating structure having a multicomponent woven fabric. In a preferred embodiment, the fabric is elastomeric in substantially only the width direction, which is advantageous when the fabric is used in an automobile seat construction, particularly where the fabric is moderately stretched (about 10%–30% of its maximum stretch) in the width direction and affixed to the side supports of an automobile seat frame. In use, the stretch is perpendicular to the load, and unidirectional stretching along the width of the seat has been found to be particularly comfortable to a driver, especially over long trips and when encountering rough roads.

In addition to the unidirection stretch design, the fabrics used in the present invention also comprise an elastomeric monofilament which is woven into the fabric, in a continuous manner, as further described below, and this is advantageous in providing improved fit, "feel" and support.

The fabrics of the present invention also preferably comprise a reinforcing yarn which is tough and durable. Furthermore, the reinforcing yarn enables the fabric to be attached directly to a seat frame without hooks, fasteners or other specialized hardware.

Each fabric component will first be discussed separately, and then combinations of these components will be described. Finally, methods directed to the combining of these components will also be discussed.

DEFINITIONS

As used in this specification:

1. "yarns" mean monofilaments, multifilaments, cords, threads, or any strand-like structure capable of being woven into a knit fabric; and
2. "warp knitting" means any method of converting yarn from warps into a fabric, either flat or tubular.

Reinforcing Cord

The reinforcing or edge cord of the present invention provides strength and toughness to the fabric to withstand common stresses and strains imposed upon an automobile seat support fabric. Preferred reinforcing cords include extruded monofilament and especially those made from a material having an average load to break of greater than about 50 pounds, more preferably greater than about 110 pounds, yet more preferably greater than about 125 pounds and most preferably greater than about 140 pounds. Also, the average elongation to break is preferably in the range of about 30% to about 130%. Preferred reinforcing cord compositions include nylon or polyester polymers or copolymers, more preferably, nylon 6, nylon 610 and nylon 6,6 and nylon 6,69 copolymer.

In a preferred embodiment, the reinforcing cord is a nylon 6,69 monofilament, having a melt temperature about from 388° F. to 396° F. The nylon is heated above its melting temperature (preferably greater than about 390° F. and most preferably about 480° F.) and extruded from a die using a process having three draw/relax zones.

The predraw ratio is preferably in the range of about 2.7–4.0 to 1, and most preferably is about 2.8. The second draw ratio is preferably in the range of about 2.7 to 4.0, and most preferably is about 3.4. The relaxation ratio is preferably in the range of about from 0.8 to 1.0 and most preferably is about 0.87. The overall draw ratio is preferably in the range of about 2.5 to 4.0, and is most preferably about 2.97.

The predraw temperature is preferably in the range of about 300°– 500° F. and more preferably is about 350° F. The second draw temperature is preferably in the range of about 400°–550° F. and more preferably is about 450° F. The relaxation temperature is preferably in the range of about 500°–600° F. and more preferably is about 500° F. The quench temperature is preferably in the range of about 60°–80° F. and more preferably is about 70° F.

The die capillary diameter is preferably in the range of about 0.169–0.293 and more preferably is about 0.281 inches. The capillary size should be chosen to give a melt drawdown about from 1.5 to 4.5. The preferred filament size is in the range of about from 0.05 inches to 0.155 inches in diameter and more preferably is about 0.08 inches. Preferably, the reinforcing cord defines a denier of about from 13,000 to 124,930, more preferably about 33,280 denier.

A preferred extruder comprises a 2.5 inch barrel (a 1.25 inch barrel is generally also acceptable), a 20:1 length/diameter screw, 0.281 inch diameter capillary (6 per die), and a 3.0 compression ratio screw (3.5 and 4.0 compression ratio screw can also be used).

The size, toughness, flexibility, resistance to stressing/straining and strength of the reinforcing cord provides excellent reinforcement properties when incorporated into a fabric as further described below.

Elastomer Yarn

The elastomer yarn of the present invention provides stretch to the fabric and preferably is capable of withstanding common stresses and strains imposed upon an automobile seating support fabric. Preferred elastomer yarns include extruded monofilament and the like.

The elastomer yarn is preferably comprised of a tough, elastomeric material, having a average load to break of greater than about 2000 grams, more preferably greater than about 3000 grams, yet more preferably greater than about 3500 grams and most preferably greater than about 3700 grams. Also, the average elongation to break is preferably in the range of about 30% to about 130%, most preferably about 77%.

The average tenacity is preferably about 1.6 grams per denier and is preferably greater than about 1.2 grams per denier. The average energy to break is preferably greater than about 10,000 gm-cm, more preferably greater than about 40,000 gram-cm about 67,000 gram-cm or more. The average load at 10% elongation is preferably about 600–1600 grams, more preferably about 1100 grams. The average load at 25% elongation is preferably about 2300–3300, more preferably about 2800 grams. The average load at 50% elongation is preferably about 2600–3600, more preferably about 3100 grams.

The preferred elastomer yarn comprises a block copolymer derived from polybutylene terephthalate ("PBT") and polyether glycol, preferably having a large mole fraction of PBT. This material has been found to have advantageous stiffness, compared to many other elastomeric filaments. A preferred such material is available from E.I. du Pont de Nemours and Company under the trademark HYTREL, such as HYTREL 7246, HYTREL 40CB, HYTREL 4056 and combinations thereof. The most preferred composition comprises from about 90 to about 100 weight percent HYTREL 7246, more preferably about 92 weight parts HYTREL 7246 and from about 0–10 weight parts HYTREL 40CB, more preferably about 8 weight parts HYTREL 40CB. Other useful compositions for the elastomer yarn could include any appropriate elastomeric material, and ordinary skill and experimentation may be necessary in choosing the most appropriate elastomeric material, depending upon the particular application or embodiment of the present invention.

The preferred filament size is about 0.017 to about 0.023 inches, more preferably about 0.02 inches in diameter and about 1645 to about 3015 denier, more preferably about 2280 denier.

In a preferred embodiment, the elastomeric material is heated above its melting temperature (preferably greater than about 425° F. and most preferably about 490° F.) and extruded using a process having three draw/relax zones.

The predraw ratio is preferably in the range of about 2.7–5.5, and most preferably is about 4.0. The second draw ratio is preferably in the range of about 2.7 to 5.5, and most preferably is about 4.0. The relaxation ratio is preferably in the range of about 0.8 to about 1.0, and most preferably is about 0.90. The overall draw ratio is preferably in the range of about 2.7 to about 5.5 and is most preferably about 3.6.

The predraw temperature is preferably in the range of about 250°–350° F. and preferably is about 260° F. The second draw temperature is preferably in the range of about 275°–350° F. and most preferably is about 285° F. Relaxation temperature is preferably in the range of about 300°–350° F. and most preferably is about 310° F. The quench temperature is preferably in the range of about 65°–100° F. and most preferably is about 80° F.

The die capillary diameter is preferably in the range of about 0.054 to about 0.093 and more preferably is about 0.076 inches. The capillary size should be chosen to give a melt drawdown of from about 2 to about 6. The preferred filament size is in the range of about 0.004 inches to about 0.030 inches in diameter and more preferably is about 0.02 inches. Preferably, the elastomer yarn defines a denier of about 91 to about 5130 denier, more preferably about 2280 denier.

A preferred extruder comprises a 2.5 inch barrel (a 1.25 inch barrel is generally also acceptable), a 20:1 length/diameter screw 0.076 inch diameter capillary (5 per die), and a 3.0 compression ratio screw (3.5 and 4.0 compression ratio screws can also be used).

The most preferred elastomer yarn is that available from Shakespeare, Monofilament Division, sold under the trademark "EX-110." By pretensioning the elastomer yarn within the fabric on a seat frame, a firm support can be achieved. The smaller the diameter of the elastomer yarn, the more picks per inch are generally needed in the fabric to achieve acceptable fabric strength and stiffness. The preferred elastomer yarns have appropriate modulus to deflect sufficiently for passenger comfort, yet not change significantly when additional forces incur due to sudden stops or the like. The preferred elastomer yarns will not take a set, either short term or long term, and the elastomer preferably fully recovers its extensibility after loading.

Knitting Yarn

The knitting yarns are preferably flat or textured polyester yarn in a denier ranging from about 70 to about 500 denier. Other yarns which can be used include nylons and polypropylene.

Non-Elastomeric Lay-In Yarn

The non-elastomeric lay-in yarns generally are about from 70 to 2000 denier, and preferably about 1000 denier. This yarn is preferably polyester, although nylon can also be used for this component.

Combining The Fabric Components

The fabrics of the present invention are created by knitting some or all of the above described yarns into a mesh. Preferably, the knit is of a type which prevents permanent shifting of the yarns (particularly in the warp and/or weft direction), when the fabric is stretched in any direction. Warp knitting is most preferred.

The preferred warp knitting process is a Raschel knit, using latch-type needles which are substantially in the same plane as the fabric being knitted. Raschel knitting processes in general are well known in the textile industry.

Most conventional Raschel knitting machines permit traversing movement of a lay-in yarn of up to only about 1 inch and typically about 0.25 inches. However, knitting machines used for the present invention should be capable of traversing the elastomeric thread along substantially the entire width of the fabric. The lay-in yarn stops at the fabric edge or selvage and continues as one continuous yarn in consecutive courses. Furthermore, in other embodiments of the present invention, other lay-in yarns can additionally be used which traverse more than an inch across the fabric.

Such extreme traversing of one or more lay-in yarns is preferably accomplished by replacing the pattern wheel of many conventional Raschel knitting machines and substituting an independent cam which drives a sliding device on the Raschel pattern bar. Preferably, the sliding device slides within a dove tail groove. Preferably, a steel cable is affixed to a roller chain which propels the sliding device back and forth across all or part of the pattern bar.

The independent cam allows the sliding device to shift and stop in time with the balance of the knitting motion. Yarn is preferably provided by feeding the yarn through a tube which is affixed to the sliding device. Preferably, the sliding device strokes exactly the same distance with each course, because the tube must cross through the gap between knitting needles at the correct position; otherwise, the tube might contact the needles and thereby cause broken needles and defective fabric.

Referring now to the drawings, the preferred fabric of the present invention is shown generally at 10 in FIG. 1. Preferably, reinforcing cords 12 and 12' are placed in the warp direction and are substantially straight (or in other words, have a stitch notation of 0-0-0-0). Generally, only two reinforcing cords are provided per fabric with one near each selvage as shown generally at 14 in FIG. 1.

Preferably, the reinforcing cord's pattern bar does not traverse back and forth across the width of the fabric. In the wale 16 where the reinforcing cord 12 is inserted, the knitting yarn from this pattern bar is omitted. The restraining cord 12 is held in place on the front side by a warp knitted yarn 18 and on the back side by the elastomer yarn 20.

Elastomer yarn 20 is preferably controlled by the independent cam system described above. The elastomer yarn 20 is preferably traversed the full width of the fabric via slides which are controlled by cables and a roller chain. In continuous fashion, the elastomer yarn traverses from the fabric selvage edge across the full width and traverses back without any break in the yarn in similar fashion to filling in a shuttle loom fabric. The tension of the elastomer yarn can be adjusted by the knitting mechanism and in turn the tension of the elastomer yarn in the fabric will control the final fabric width and influence fabric stretch.

The elastomer yarn is incorporated perpendicular to the reinforcing cord (in the weft direction) in one continuous strand without deflection across the width of the fabric. Preferably, the elastomer is not broken between courses; hence there is no tendency for the elastomers to creep back after loading.

Preferably at least one (more preferably only one) elastomer yarn is inserted the full width of the fabric, whereby the elastomer yarn is continuous from course to course and not cut and terminated at the fabric edge. This is to be contrasted with many conventional designs where the elastomeric yarns are knitted into the fabric in the warp (length) direction as opposed to the weft (width) direction of the present invention. Furthermore, conventional designs generally cut each laid-in yarn at the end of each course, whereas the laid-in elastomeric yarn of the present invention is not cut at each course, but rather is continuous throughout each selvage, thereby providing improved durability and performance.

Preferably, the final fabric has width stretch which is controlled exclusively by the elastic yarn and not by the deflection of the knit loops. The fabric has uniform stretch from course to course, because the yarns are continuous from course to course. In particular, the continuity of the elastomer yarn substantially eliminates pull-back of the elastomer yarn, which provides durability, and improved performance.

The first bar is the knitting bar and has the stitch notation 2-0-0-2. The knitting yarn in the body of the fabric is preferably threaded one end per guide and per needle. The selvage is preferably threaded as follows (beginning at the fabric edge):

wale 1—1 end/guide from a creel or spot beam wale 2—1 end/guide from a creel or spot beam wale 3—2 end/guide supplied from warp wale 4—skip wale 5—2 end/guide supplied from warp wale 6—1 skip wale 7— begin body of fabric threaded one end per guide The first bar knitting yarn 18 is knitted from either a flat or textured polyester yarn in denier ranging from about 70 to about 500 denier.

The second bar lay-in yarn 22 is preferably knitted in a stitch notation of 0-0-6-6. The yarn supplied from a warp is threaded one end per guide. Each yarn 22 alternately overlaps three needles. Yarn 22 is preferably about the same denier as yarn 18 and ranges from about 70 to about 500 denier.

Bar 3 controls the monofilament reinforcing cords 12 and 12', and has a pattern 0-0-0-0.

Bar 4 controls the elastomeric yarn 20, which traverses the full width of the fabric. It is controlled by an external cam which controls a yarn guide affixed to a sliding device by means of cable and roller chain.

On the fifth bar Yarn 24 is preferably a 1000 denier yarn and preferably has a stitch notation of 2-2-0-0. This yarn generally provides the fabric with length oriented strength. The lay-in motion is preferably fight to left and then, left to right on the non-latch side of the needle while the needle is in the up position. Yarn 24 preferably follows a wale and is held in place by the knitting yarn 18.

The number of wales, and accordingly the width of the fabric, will vary with the intended use. Typically the fabric will have nine wales per inch.

After preparation of the fabric, it can be cut to size and sealed to prevent the warp fibers from unraveling by conventional means. These means can include a heated knife, ultrasonic cutting means or laser cutting means. Of these, ultrasonic cutting means are generally preferred.

After cutting to size, the fabric, in dimensions appropriate to the seating frame to be used, is attached to the seating frame by any one of a number of attaching or anchoring means. Such attaching means which can be used include metal hooks (see, FIGS. 3*a* and 3*b*), push-pin fasteners (see, FIG. 3*c*), tube insertion (see, FIG. 3*d*), locking clamp fasteners (see, FIG. 3*e*), and similar attachment devices used in the upholstery industry. In FIGS. 3*a–e*, the fabric 100, comprising edge cord 102, is fastened to seat frame 104, using a fastener mechanism 106*a, b,c,d* or *e*. In a seating construction, the reinforcing cords of the present invention are preferably installed parallel to the sides of either the seating component of the structure or the back component of the structure.

In the finishing of the fabric prior to installation, it has been found that the heat generated by the various cutting mechanisms, such as the heated knife, the ultrasonic cutting means or the laser device, tends to fuse the ends of the fabric and further reduce unraveling.

Figure 2:
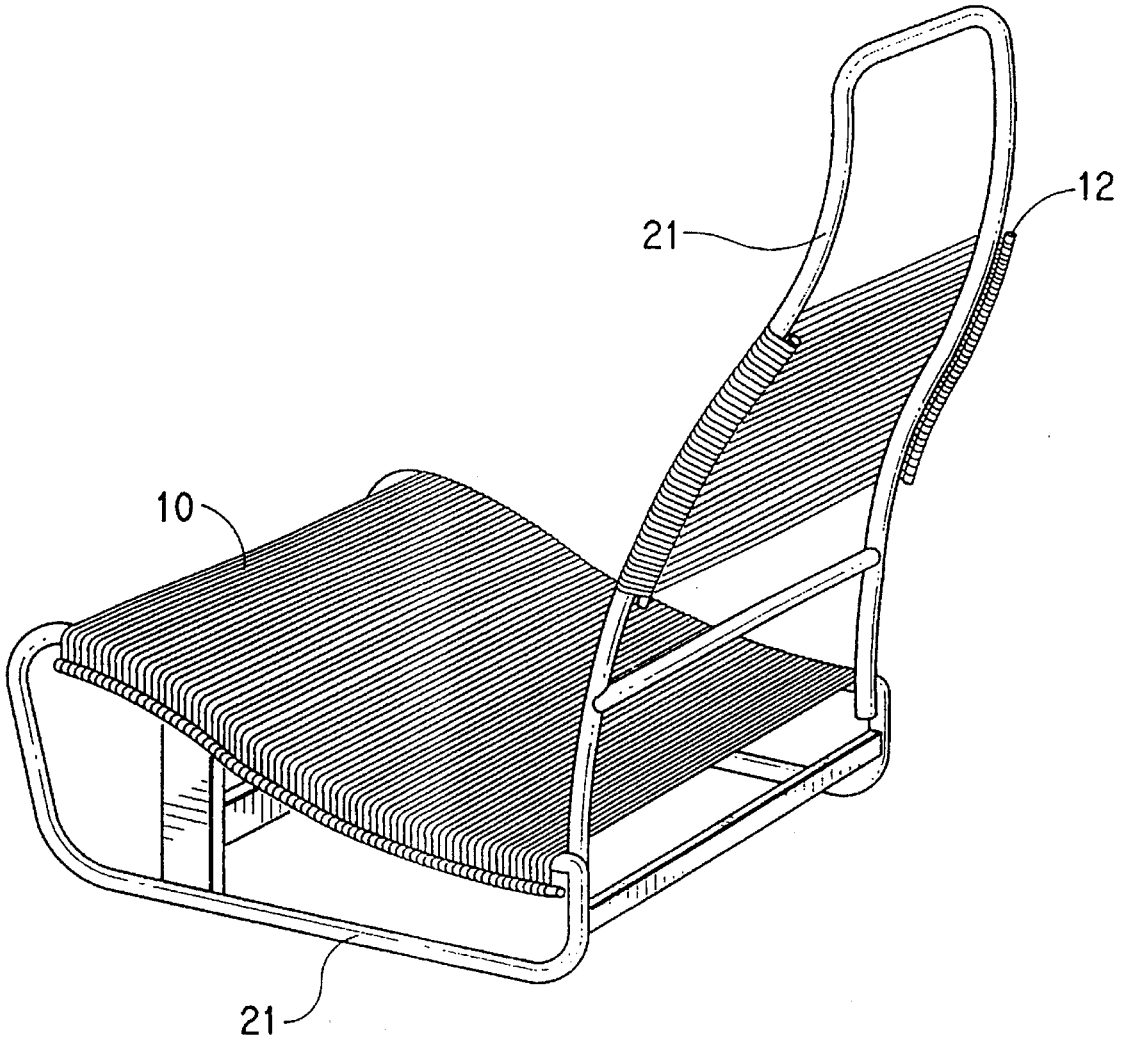
FIG. 2 is a representative seat construction of the present invention.
Figure 3A:
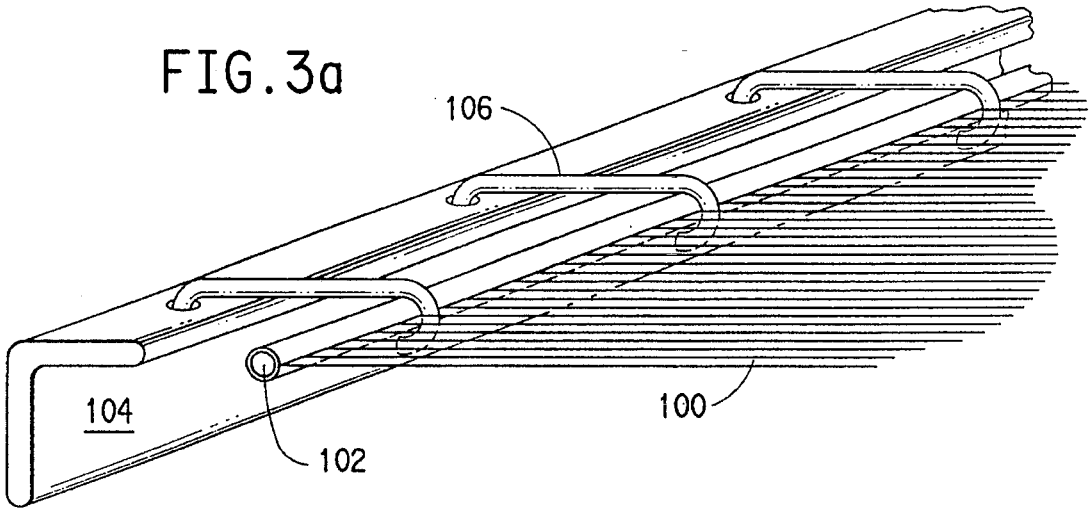
FIG. 3*a* is a perspective plan view of a preferred attachment mechanism for attaching the fabrics of the present invention to a seat frame.
Figure 3B:
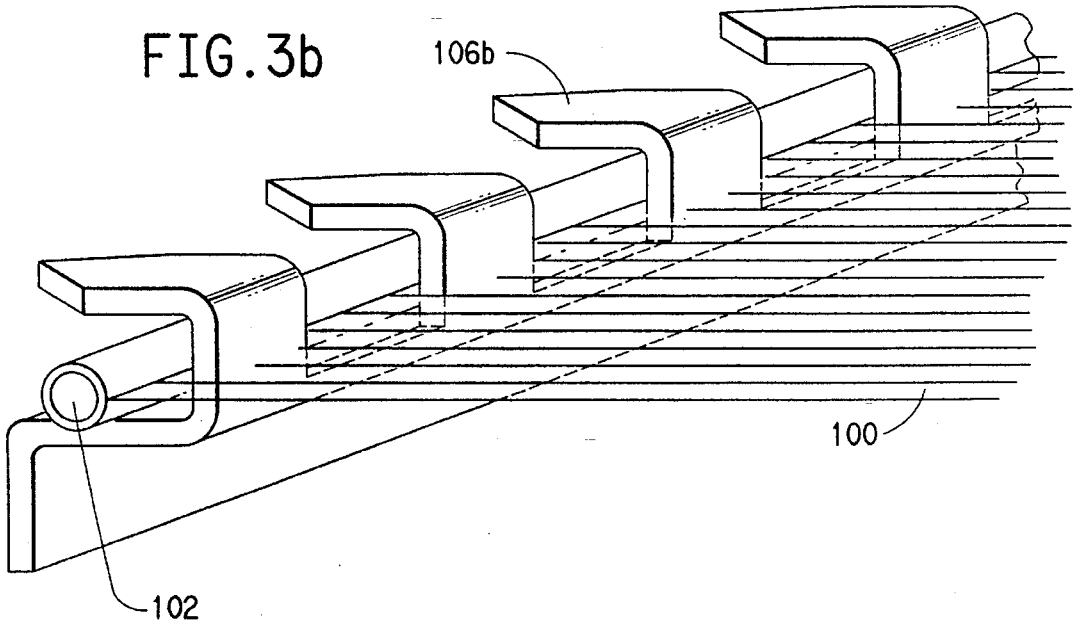
FIG. 3*b* is a perspective plan view of a second preferred attachment mechanism for attaching the fabrics of the present invention to a seat frame.
Figure 3C:
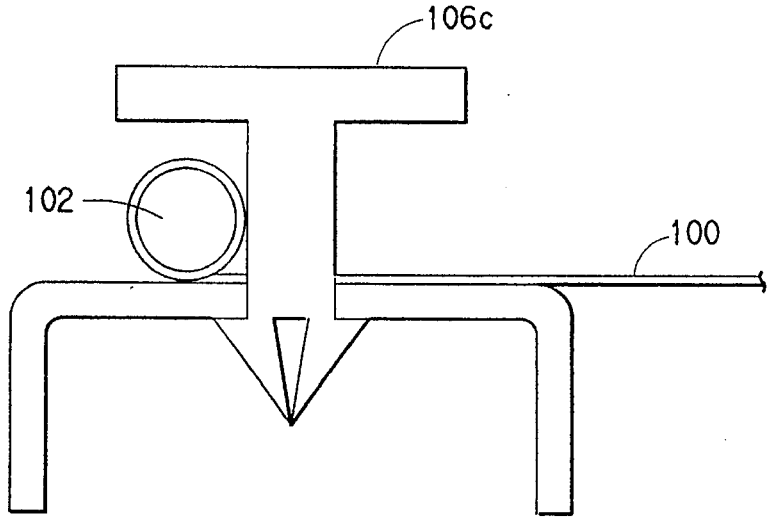
FIG. 3*c* is a perspective plan view of a third preferred attachment mechanism for attaching the fabrics of the present invention to a seat frame.
Figure 3D:
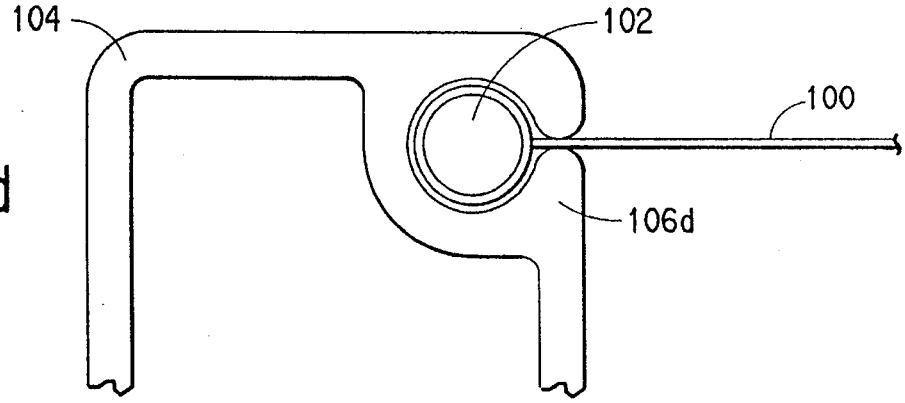
FIG. 3*d* is a perspective plan view of a fourth preferred attachment mechanism for attaching the fabrics of the present invention to a seat frame.
Figure 3E:
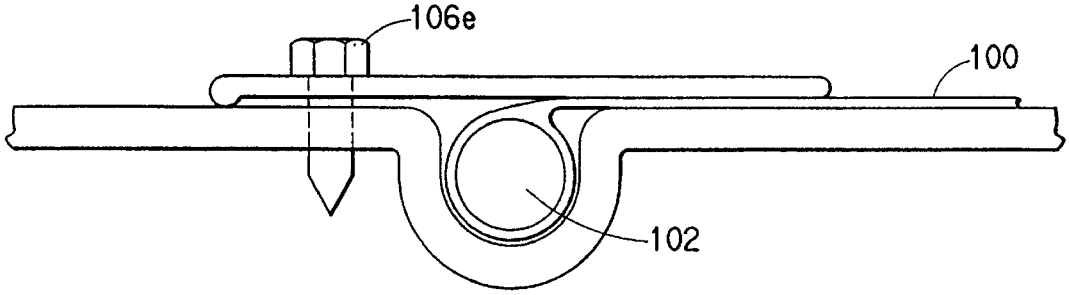
FIG. 3*e* is a perspective plan view of a fifth preferred attachment mechanism for attaching the fabrics of the present invention to a seat frame.

A seating construction of the present invention is illustrated in FIG. 2, in which a fabric of the present invention 10, with reinforcing edge cord 12, is anchored in a seating structure by a hook fastener 106 or by any other appropriate fastener mechanism, such as is shown in FIGS. 3*a–e* at 106*a–e*, respectively. The fabric 10 is fastened across the seat frame as illustrated in FIG. 2. In alternative embodiments, the seat frame can be adjustable, either manually or by means of electric motor(s). Other possible additions to the seat would include head rests, seat belts, shoulder harnesses, extra padding, decorative coverings and the like.

The above discussion has been provided merely to enable a person of ordinary skill to fully understand the best mode and preferred embodiments and is not intended to create any limitation to the present invention. The metes and bounds of the present invention are intended to be defined solely by the claims provided below.

We claim:

1. A seating structure comprising a warp knit fabric attached to a frame, the fabric having a front side; a rear side; at least one selvage; a plurality of wales; and a plurality of courses, the fabric further comprising:

a) at least one restraining cord adjacent each selvage located substantially in the warp direction;

b) an elastomeric monofilament substantially perpendicular to each restraining cord and located along the full width of the fabric in the weft direction, wherein the elastomeric monofilament is substantially continuous from course to course;

the wrap knit fabric encompassing the restraining cord and elastomeric monofilament together in a mesh which locks the monofilament and cord together in a substantially permanent relative position when the fabric is in a substantially non-stretched state.

2. A fabric of claim 1 wherein the width stretch is substantially controlled by the elastomeric monofilament.

3. A seating structure of claim 1 wherein each restraining cord is a monofilament of nylon having an average load to break of greater than about 100 pounds and an average elongation to break in the range of about 30% to about 130%.

4. A seating structure of claim 3 wherein the restraining cord comprises nylon 6,69 having a melt temperature in the range of about 388° F. to about 396° F.; the restraining cord is extruded in a process having three draw/relax zones; the predraw ratio is in the range of about 2.7–4.0; the second draw ratio is in the range of about 2.7 to 4.0; the relaxation ratio is in the range of about 0.8 to about 1.0, the overall draw ratio is in the range of about 2.7 to about 4, the predraw temperature is in the range of about 300°–500° F., the second draw temperature is in the range of about 400°–550° F., the relaxation temperature is in the range of about 500°–600° F. and the quench temperature is in the range of about 60°–80° F.

5. A seating structure of claim 4, wherein the restraining cord has a filament size in the range of about from 0.05 inches to 0.155 inches in diameter and a denier of about from 13000 to 124930.

6. A seating structure of claim 1 wherein the elastomeric yarn is a monofilament, having an average load to break of greater than about 2000 grams, an average elongation to break in the range of about 30% to about 130%, an average tenacity of about 1.6 grams per denier, an average energy to break in the range of about 62,000 to about 72,000 gram-cm, an average load at 10% elongation of greater than about 600 grams, an average load at 25% elongation of greater than about 2300 grams, an average load at 50% elongation of greater than about 2600 grams.

7. A seating structure of claim 6 wherein the elastomeric yarn comprises a block copolymer derived from butylene terephthalate ("PBT") and polyether glycol having a large mole fraction of PBT of greater than about 0.5.

8. A seating structure of claim 6 wherein the elastomeric yarn is a monofilament having a diameter of about from 0.004 inches to about 0.030 inches in diameter and a denier of about from 91 to 5130.

9. A seating structure of claim 6 wherein the elastomeric yarn is a monofilament derived from an extrusion process having three draw/relax zones, whereby the predraw ratio is in the range of about 2.7–5.5, the second draw ratio is in the range of about 2.7 to 5.5, the relaxation ratio is in the range of about 0.8 to about 1.0, the overall draw ratio is in the range of about 2.7 to about 5.5, the predraw temperature is in the range of about 250°–350° F., the second draw temperature is in the range of about 275°–350° F., the relaxation temperature is in the range of about 300°–350° F., the quench temperature is in the range of about 65°–100° F., the die capillary diameter is preferably in the range of about 0.054 to about 0.093 inches.

10. A seating structure of claim 2 further comprising a warp knitted yarn (hereafter, "YARN # 1") which is substantially located within a first wale, YARN # 1 comprising a flat or textured yarn having a denier ranging from about 70 to about 500 denier.

11. A seating structure of claim 10 further comprising a first warp knitted lay-in yarn (hereafter, "YARN #2") which alternatively overlaps more than two wales.

12. A seating structure of claim 11 further comprising a second warp knitted lay-in yarn (hereafter, "YARN #3") which is substantially knitted into said first wale.

13. A seating structure of claim 12 wherein YARN #1 comprises polyester and the stitch notation of YARN # 1 is 2-0-0-2.

14. A seating structure of claim 13 wherein:

a) YARN #2 comprises a flat or textured yarn having a denier ranging from about 70 to about 500 denier;

b) YARN #2's stitch notation is 0-0-6-6; and c) YARN #2 overlaps three wales in alternating fashion.

15. A seating structure of claim 14, wherein each restraining cord is a monofilament having a diameter greater than about 0.01 mil.

16. A seating structure of claim 15, wherein the fabric has two restraining cords, wherein the first restraining cord is in close proximity to a first selvage and the second restraining cord is in close proximity to a second selvage.

17. A seating structure of claim 16, wherein the restraining cords are substantially straight and define a stitch notation of 0-0-0-0.

18. A seating structure of claim 17 wherein the restraining cords are held in place on the front side by YARN #2 and on the back side by the elastomeric monofilament.

19. A seating structure of claim 18 wherein YARN #3 defines a stitch notation of 2-2-0-0 and is wholly or partially held in place by YARN # 1.

20. A seating structure of claim 19 wherein the width stretch of the fabric is controlled substantially by the elastomeric monofilament.

21. A seating structure of claim 1 wherein the frame defines a front support, a rear support, a first side support and a second side support; and the warp knitted fabric is stretched by at least about 2% in the weft direction and fastened across the first side support and the second side support, whereby the weft direction of the fabric is substantially perpendicular to the first and second side supports.

22. A warp knit fabric having a front side, a rear side, at least one selvage; a plurality of wales; and a plurality of courses, the fabric further comprising:

a) at least one restraining cord adjacent each selvage located substantially in the warp direction;

b) an elastomeric monofilament substantially perpendicular to each restraining cord and located along the full width of the fabric in the weft direction, wherein the elastomeric monofilament is substantially continuous from course to course;

wherein the wrap knit fabric encompassing the restraining cord and elastomeric monofilament together in a mesh which locks the monofilament and cord together in a substantially permanent relative position when the fabric is in a substantially non-stretched state.

23. A seat comprising:

a) a frame;

b) a fabric mechanically fastened and stretched across the frame, said fabric comprising:

i) at least one restraining cord adjacent each selvage located substantially in the warp direction;

ii) an elastomeric monofilament substantially perpendicular to each restraining cord and located along the full width of the fabric in the weft direction, wherein the elastomeric monofilament is substantially continuous from course to course;

wherein the wrap knit fabric encompassing the restraining cord and elastomeric monofilament together in a mesh which locks the monofilament and cord together in a substantially permanent relative position when the fabric is in a substantially non-stretched state.

24. A seat of claim 23 whereby the fabric is mechanically fastened to the frame by tube insertion, hooks, push-pin fasteners, locking clamp fasteners or combinations thereof.

* * * * *